US006083654A

United States Patent [19]

Lin

[11] Patent Number: 6,083,654

[45] Date of Patent: Jul. 4, 2000

[54] TONER COMPOSITIONS AND PROCESSES THEREOF

[75] Inventor: Pinyen Lin, Rochester, N.Y.

[73] Assignee: Xerox Corporation, Stamford, Conn.

[21] Appl. No.: 09/216,758

[22] Filed: Dec. 21, 1998

[51] Int. Cl.[7] ..... G03G 9/097

[52] U.S. Cl. ..... 430/110; 430/137

[58] Field of Search ..... 430/110, 137

[56] References Cited

U.S. PATENT DOCUMENTS

| | | | |
|---|---|---|---|
| 3,165,420 | 1/1965 | Tomanek et al. | 430/110 |
| 3,236,776 | 2/1966 | Tomanek et al. | 430/109 |
| 3,655,374 | 4/1972 | Palermiti et al. | 430/121 |
| 4,145,300 | 3/1979 | Hendriks | 430/109 |
| 4,271,249 | 6/1981 | Gilliams et al. | 430/101 |
| 4,556,624 | 12/1985 | Gruber et al. | 430/110 |
| 4,557,991 | 12/1985 | Takagiwa et al. | 430/109 |
| 4,604,338 | 8/1986 | Gruber et al. | 430/106 |
| 4,795,689 | 1/1989 | Matsubara et al. | 430/99 |
| 4,917,982 | 4/1990 | Tomono et al. | 430/99 |
| 4,921,771 | 5/1990 | Tomono et al. | 430/110 |
| 4,971,882 | 11/1990 | Jugle | 430/110 |
| 4,988,598 | 1/1991 | Tomono et al. | 430/99 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,712,071 | 1/1998 | Mikuriya et al. | 430/110 |
| 5,741,617 | 4/1998 | Inaba et al. | 430/110 |
| 5,843,612 | 12/1998 | Lin et al. | 430/110 |

FOREIGN PATENT DOCUMENTS

| | | |
|---|---|---|
| 1442835 | 7/1976 | United Kingdom . |

*Primary Examiner*—Roland Martin
*Attorney, Agent, or Firm*—John L. Haack

[57] ABSTRACT

A toner including a resin, a colorant, and a bimodal wax.

19 Claims, No Drawings

TONER COMPOSITIONS AND PROCESSES THEREOF

REFERENCE TO COPENDING APPLICATIONS AND ISSUED PATENTS

Attention is directed to commonly owned and pending applications: U.S. Ser. No. 09/019,527, filed Feb. 5, 1998, now U.S. Pat. No. 5,916,722 entitled "TONER COMPOSITIONS", which application discloses a toner comprised of a mixture of first toner with wax, and second toner free of wax, and wherein the first and the second toner contain resin, and the first toner with wax contains colorant; U.S. Ser. No. 09/058,997, filed Apr. 13, 1998, now U.S. Pat. No. 5,948,583 entitled "TONER COMPOSITIONS AND PROCESSES THEREOF", which application discloses a toner including a mixture of first toner with high molecular weight wax, and second toner with a low molecular weight wax; and U.S. Ser. No. 09/110,170, filed Jul. 6, 1998, pending entitled "TONER COMPOSITIONS AND PROCESSES THEREOF", which application discloses a process including: mixing a resin, and a mixture of a first wax and a second wax; and grinding and classifying.

The disclosures of the above mentioned copending applications are incorporated herein by reference in their entirety. The appropriate components and processes of these applications may be selected for the toners and processes of the present invention in embodiments thereof.

BACKGROUND OF THE INVENTION

The present invention is generally directed to toner and developer compositions, and more specifically, the present invention is directed to negatively, or positively charged toner compositions, and toner particles containing wax additives. More specifically the present invention relates to toners and processes thereof, and which toners comprise a resin, a colorant, and a bimodal wax. The toners possess a number of advantages, including minimization, or elimination of toner flow reduction, or fall off, improved toner transfer, acceptable developed toner mass, reduction in the amount of wax that escapes from the toner, and providing images with excellent resolution, and reduced background deposits after extended imaging cycles, for example, after about 500,000 imaging cycles. The aforementioned toner compositions can contain colorants of for example, pigment particles comprised of, for example, carbon black, magnetites, or mixtures thereof, cyan, magenta, yellow, blue, green, red, or brown components, or mixtures thereof, and preferably carbon black, thereby providing for the development and generation of black and/or colored images, and in embodiments single component development wherein a carrier or carrier particles are avoided. The toner and developer compositions of the present invention can be selected for electrophotographic, especially xerographic, imaging and printing processes, including color processes.

PRIOR ART

In U.K. Patent Publication 1,442,835, there are disclosed toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58.

Numerous patents disclose the use of metal salts of fatty acids for incorporation into toner compositions, such as U.S. Pat. No. 3,655,374. Toner compositions with waxes, such as low molecular weight waxes are known, and such toners are illustrated in for example, U.S. Pat. Nos. 5,023,158, 5,004,666, 4,997,739, 4,988,598, 4,921,771, 4,917,982, and 4,795,689. Furthermore, references of background interest are U.S. Pat. Nos. 3,165,420; 3,236,776; 4,145,300; 4,271,249; 4,556,624; 4,557,991; and 4,604,338, the disclosures of each patent being totally incorporated herein by reference.

There remains a need for an economical, efficient, and environmentally acceptable method for the preparation of toners with, for example, superior flow, environmental stability, and charging properties, and imaging processes thereof.

SUMMARY OF THE INVENTION

Embodiments of the present invention, include providing:

A toner comprising a resin, a colorant, and a bimodal wax;

A toner comprising a resin, a colorant, and an oligomodal wax;

A process comprising: admixing a first high molecular weigh monomodal wax component with a second low molecular weight monomodal wax component to form a homogenous bimodal wax mixture; and admixing the bimodal wax mixture with a resin and a colorant to form a toner; and An imaging process comprising: contacting a toner comprising a resin, a colorant, and a bimodal wax, with a charged image receiving member, wherein a printed image results with high image quality and fidelity.

These and other embodiments are illustrated herein.

DETAILED DESCRIPTION OF THE INVENTION

Aspects of the present invention include: a toner comprising a resin, a colorant, and a bimodal wax.

The resin can be selected in amounts of from about 10 to about 99 weight percent, the colorant can be selected in amounts of from about 1 to about 60 weight percent of the total weight of the toner. The resin can be, for example, a styrene-butadiene, styrene acrylate, a styrene methacrylate, or a polyester. A preferred resin selection is a polymer such as a polyester, copolyester, and mixtures thereof, including a reactively extruded polyesters such as illustrated, for example in, U.S. Pat. Nos. 5,376,494 and 5,234787, the disclosures of which are incorporated by reference herein in their entirety, and mixtures thereof.

The colorant can be a pigment, a dye, and mixtures thereof, and can be present in amounts of from about 1 to about 20 weight percent based on the total weight of the toner. The colorant can be, for example, a carbon black, a magnetite, a cyan pigment, a magenta pigment, a yellow pigment, a red pigment, a green pigment, a blue pigment, a brown pigment, and mixtures thereof.

The bimodal wax can be, for example, a first low molecular weight wax component with a weight average molecular weight of about 1,000 to about 4,000, and a second high molecular weight wax component with a weight average molecular weight of about 10,000 to about 1,000,000. The bimodal wax can be, for example, 5 polyalkylene waxes, such as those waxes prepared from unsaturated monomers having from 2 to about 12 carbon atoms, paraffin waxes, carnuba waxes, oxidized polyolefins, polyolefins with acid groups, polyolefins with hydroxyl groups, and mixtures thereof. The bimodal wax can be present in amounts of from about 0.01 to about 20, preferably from about 0.5 to about 5 weight percent, and more preferably from about 0.5 to 2 weight percent of the total weight of the toner. The weight average molecular weight difference between the high molecular weight component and the low molecular weight component can be, for example, from about 2,000 to about 500,000.

In embodiments, the bimodal wax component can include, for example, a third wax component or wax fraction of intermediate molecular weight between the low and the high molecular weight fractions of the bimodal wax, with a weight average molecular weight of about 6,000 to about 9,000. The resulting trimodal wax provides a toner that has about 30 weight percent less surface wax compared to a toner prepared with monomodal wax. Less surface wax on toner provides better toner powder flow, higher triboelectricity. Surface wax or "free wax" usually produces undesired lower solid area densities. The presence of surface wax or free wax can be readily detected and quantitated by instrumentation, for example, X-ray photoelectron spectroscopy (XPS).

The bimodal wax can include additional wax components, for example, a single wax component or multiple wax components, such as from 1 to about 10 additional wax components, to provide a toner containing a phase compatible oligomodal wax. The number of the molecular weight distribution peaks of the oligomodal wax can be detected, quantitated, and characterized by, for example, gel permeation chromatograph (GPC). Distinct component wax peaks can be, for example, from about 2 to about 10 in the oligomodal wax. The bimodal wax and oligomodal wax mixtures can be further characterized by their molecular polydispersity properties. In a preferred embodiment the bimodal wax can have a polydispersity of about 10 to about 100. In a preferred embodiment the oligomodal wax can have a polydispersity of about 15 to about 200.

The cohesion flow value of the formulated toner composition can be from about 30 to about 65 percent. The toner admix time can be, for example, less than about 1 to about 15 seconds, and have a triboelectric charge of from about 10 to about 40 microcoulombs per gram.

The present invention also embodies a process comprising:

admixing a first high molecular weight monomodal wax component with a second low molecular weight monomodal wax component to form a homogenous bimodal wax mixture; and admixing the bimodal wax mixture with a resin and a colorant to form a toner.

The present invention also embodies an imaging process comprising:

contacting a toner comprising a resin, a colorant, and a bimodal wax, with a charged image receiving member, wherein a printed image results with high image quality and fidelity.

The first and second monomodal wax components are comprised of compounds of the same chemical family or species, that is, for example, homologous chemical structures and differ substantially only in molecular weight, molecular weight distribution properties, and crystallinity characteristics. The ratio of maximum molecular weights of each wax component, that is, the ratio of the high or second molecular weight wax component to the low or first molecular weight component can be from about 10:1.0 to about 1,000:1.0. The relative weight ratio of the first wax component to the second wax component can be from about 0.05 to about 0.60. The low molecular weight wax can have a weight average molecular weight of about 1,000 to about 4,000, and preferably from about 1,500 to about 3,500, for example, VISCOL 660P™ polypropylene wax available from Sanyo with a weight average molecular weight of about 2,500. The high molecular weight wax can have, for example, a weight average molecular weight of about 10,000 to about 1,000,000, and preferably from about 50,000 to about 300,000, for example, Polypropylene homopolymer 7957™ available from Amoco Polymers with a weight average molecular weight of about 125,000. The molecular weight difference between the low molecular weight wax and the high molecular weight wax can be from about 10,000 to about 500,000, and preferably from about to 20,000 to about 200,000.

In embodiments, two bimodal and chemically different waxes can be included in the toner, that is, structurally different, for example, a bimodal polyalkylene wax and a bimodal hydroxy polyalkylene wax.

The waxes are selected primarily to achieve the desired fusing performance and print quality. For example, the desired fusing properties can be expressed as a temperature range between either the lowest temperature at which the toner is fixed to the paper in the fusing subsystem, referred to as the minimum fix temperature (MFT) of the toner, or the lowest temperature at which no effect is detectable on the fused image from the stripper fingers which fingers serve to detach the paper from the fuser role, referred to as the stripper finger mark temperature and the highest temperature above which the toner is offset to the fuser roll, referred to as the hot offset temperature (HOT). Ideally this temperature range is greater than about 30° C., with a minimum practical value of about 20 to about 25° C. The desired print quality can be expressed as the sustainability of printed image under a rubbing force which occurs as the printed image goes through a magnetic reader head or through a duplex mode.

Although not wanting to be limited by theory, the toners of the present invention can be viewed as incorporating a single wax component into the toner bulk and wherein the wax has a bimodal molecular weight distribution so that each of the two unimodal molecular weight constituents or ranges are present in all toner particles; that is, both low molecular weight and high molecular weight component of wax exist in the same wax domain in the toner particles.

The toners of the present invention in embodiments possess initial or unaged toner cohesion flow values of less than about 25 percent, that is, from about 5 to about 25 percent, and after aging, for example when aged in an aggressive xerographic development environment, of below about 65 percent, that is from about 50 to about 65 percent as measured with a Hosokawa Powder Tester available from Micron Powders Systems. The toner cohesion flow values are a quantifiable measure of the flow characteristics of a given material, which can be related to the degree to which a toner develops onto a photoreceptor in the xerographic development step. The higher the cohesion value, the lower the flowability of the toner. The maximum, or no flow, cohesion value is 100, the minimum, or freely flowing value, approaches zero. The flow measurement technique involves placing a known mass of toner, for example two grams, on top of a set of three screens, for example with screen meshes of 53 microns, 45 microns, and 38 microns, in order from top to bottom, and vibrating the screens and toner for a fixed time at a fixed vibration amplitude, for example, for 90 seconds at a 1 millimeter vibration amplitude. Thereafter, the mass of toner remaining on each screen is measured and the measured masses are used to compute the cohesion. A cohesion value of 100 corresponds to all of the toner remaining on the top screen at the end of the vibration step and a cohesion value of zero corresponds to all of the toner passing through all three screens, that is, no toner remains on any of the three screens at the end of the vibration step.

Also, the present invention relates to compositions and processes for the preparation of toners with, for example, enhanced flowability and which processes comprise admixing a toner composition wherein the toner particles each substantially contain resin, bimodal wax, charge-controlling agents, colorant, and optionally a compatibilizer compound. In embodiments, the bimodal waxes can be produced by mixing the high molecular weight wax component and the low molecular weight wax component through melt mixing, solution blending, and the like other mixing methods. The bimodal wax can, for example, melt mixed with other toner ingredients such as resin, charge-controlling agents, colorant, and optionally a compatibilizer compound. The toner particles produced contain uniformly distributed and homogenous wax domains, ranging from about 0.01 micron to about 2 microns in diameter. The bimodal wax which contains both a high molecular weight portion and a low molecular weight portion can be found in each wax domain and which domains can be found in approximately equal amounts in substantially each toner particle.

In embodiments, the toner can comprise one or more bimodal waxes. The additional bimodal waxes can be chemically the same or different. For example, the toner can comprise a bimodal polyethylene wax and a bimodal polypropylene wax. The toner can contain from about 0.05 weight percent to about 20 weight percent by weight of each bimodal wax. The total wax content with respect to the total weight of the toner can be from about 0.05 weight percent to about 20 weight percent by weight.

The present invention, in embodiments, encompasses developer compositions comprised of a carrier, preferably coated carrier particles comprising a metal or metal oxide core with a coating thereover comprised of at least one polymer, and a toner composition comprised of toner resin particles, wax and colorant, especially pigment particles.

Toner compositions can be prepared by a number of known methods, such as admixing and heating resin particles such as reactive extruded polyester polymers, colorant particles such as magnetite, carbon black, or mixtures thereof, and cyan, yellow, magenta, green, brown, red, or mixtures thereof, wax, such as polypropylene wax and optionally from about 0.5 percent to about 5 percent of charge enhancing additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel and then classified.

Illustrative examples of resins suitable for toner and developer compositions of the present invention include polyesters, reactive extruded polyesters, linear or branched styrene acrylates, styrene methacrylates, styrene butadienes, vinyl resins, including linear or branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include reactive extruded polyesters such as those illustrated for example in the aforementioned U.S. Pat. No. 5,376,494. Other preferred toner resins include styrene butadiene copolymers, mixtures thereof, and the like, styrene/n-butyl acrylate copolymers, PLIOLITES®; suspension polymerized styrene butadienes, reference U.S. Pat. No. 4,558,108, the disclosure of which is totally incorporated herein by reference.

In the toner compositions, the resin particles are present in a sufficient but effective amount, for example from about 70 to about 90 weight percent. Thus, when 1 percent by weight of a charge enhancing additive is present, 5 percent by weight of a wax is present, and 10 percent by weight of pigment or colorant, such as carbon black, is contained therein, about 84 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable colorants, such as pigments or dyes can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling single component toners in some instances if desired, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

In embodiments, the toners of the present invention can further comprise a compatibilizer compound present in amounts of from about 0.5 to about 10 weight percent with respect to the total weight of the toner composition. Compatibilizer compounds include, for example, known block and multiblock polymeric compounds which diminish phase boundaries and phase separation between dissimilar polymeric materials, reference for example U.S. Pat. Nos. 5,569,572, 5,486,445, 5,516,612, and 5,364724, the disclosures of which are incorporated by reference herein in their entirety.

The waxes are chosen so as to achieve the desired fusing and development properties as the sole toner additive or in conjunction with conventional small size and large size toner additives. An exemplary small additive package is, for example: 0.6 percent by weight of a hexamethyidisilazane surface-treated silica with an 8 nanometer particle size, such as TS-530 available from Cabosil Corp.; 0.8 percent by weight of a decylsilane surface-treated titania with a 16 nanometer particle size, such as MT-3103 available from Tayca Corp.; 1.0 percent by weight of untreated titania with a 25 nanometer particle size, such as P-25 available from Degussa Chemicals; and 0.2 percent by weight of the film forming additive zinc stearate available from Synpro Inc. An exemplary large additive package is, for example: 2.8 percent by weight of a γ-aminopropyltriethoxysilane and hexamethyldisilazane surface-treated silica with an 40 nanometer particle size, such as NA50HS available from Nippon Aerosil Corp.; 2.0 percent by weight of a decyltrimethoxysilane surface-treated titania with a 40 nanometer particle size, such as SMT-5103 available from Tayca Corp.; and 0.2 percent by weight of the film forming additive zinc stearate available from Synpro Inc.

The toner can include one or more charge additives present, for example, in amounts of from about 0.05 to about 5 weight percent. There can also be blended with the toner compositions external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference. With further respect to the toners used in conjunction with the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

The bimodal waxes can be produced by melt mixing the high molecular weight wax and low molecular weight wax. The mixing devices include, for example, an extruder, and a Banbury/rubber mill mixer. The mixing temperature is from about 30° C. below the melting temperatures of the wax component to about 50° C. above of the melting temperature of the wax component. The mixing time can be from about 30 seconds to about 20 minutes. The bimodal wax component can also be produced by solution blending of high molecular weight wax with low molecular weight wax component. Solvents generally used for dissolving the wax component include linear, branched, aromatic, hydrocarbons and mixtures thereof, such as octanes and xylene. The temperature for solution blending can be from about 50° C. to about 150° C. After solution blending, the solvent can be removed in a vacuum oven at from 50° C. to about 130° C. The residual solvent can be readily detected and quantified using, using for example, gas chromatography. Residual solvent is typically and preferably less than about 50 ppm after drying. The bimodal wax component can also be produced using thermal degradation of high molecular weight waxes. For example, high molecular polypropylene can be thermally degraded using reactive extrusion with a suitable peroxide as a catalyst. The extrusion temperature can be, for example, from about 200° C. to about 350° C.

The low and high molecular weight wax components are commercially available, such as polypropylenes and polyethylenes from Sanyo Kasei KK, Allied Chemical, and Petrolite Corporation, EPOLENE N-15® is commercially available from Eastman Chemical Products, Inc., VISCOL 660P®, a low weight average molecular weight polypropylene, and 330P® a high weight average molecular weight polypropylene available from Sanyo Kasei K.K., and similar materials. The commercially available polypropylenes utilized for the toner compositions of the present invention are believed to have a molecular weight of from about 1,000 to about 4,000 for the low molecular weight polypropylene and from about 100,000 to about 300,000 for the high molecular weight polypropylene. Low molecular weight wax components such as polyethylene and polypropylene which are useful in the present invention are illustrated in British Patent No. 1,442,835, the disclosure of which is totally incorporated herein by reference.

The low and high molecular weight wax materials are present in the toner composition or the polymer resin beads of the present invention in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents or as an anti-smear additive in, for example, MICR printing applications.

Encompassed within the scope of the present invention are colored toner and developer compositions comprised of toner resin particles, carrier particles, charge enhancing additives, and as pigments or colorants red, blue, green, brown, magenta, cyan and/or yellow particles, as well as mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles are selected to be of a positive polarity enabling the toner particles, which are negatively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference, the coating generally containing terpolymers of styrene, methylmethacrylate, and a silane, such as triethoxy silane, reference U.S. Pat. Nos. 3,526,533, 4,937,166, and 4,935,326, the disclosures of which are totally incorporated herein by reference, including for example KYNAR® and polymethylmethacrylate mixtures (40/60); also carbon black loaded polymethylmethacrylate mixtures can be used. Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns, and in embodiments from about 100 to about 230 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition used in conjunction with the coated carriers of the present invention can be prepared by a number of known methods as indicated herein including extrusion melt blending the toner resin particles, wax particles, pigment particles or colorants, and optionally a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 5 to about 25 microns, more preferably from about 6 to about 12 microns, and most preferably from about 8 to about 11 microns.

Also, the toner compositions, in embodiments, of the present invention possess desirable narrow negative charge distributions, optimal charging triboelectric values, preferably of from about 8 to about 40, and more preferably from about 10 to about 30 microcoulombs per gram as determined by the known Faraday Cage methods; and rapid admix charging times as determined in the charge spectrograph of less than 15 seconds, and more preferably in some embodiments from about 1 to about 14 seconds.

Admix time for toners are preferably from about 5 seconds to 1 minute, and more specifically less than about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

TABLE 1

Bimodal Wax Containing Toners and Comparative Toners.

| EXAMPLE | % Cohesion (before/after aging) | Free wax (percent separation) | Free wax (optical microscopy) (microns) | Total wax (%) | Wax domain size (microns) | Minimum fusing (° F.) |
|---|---|---|---|---|---|---|
| I | 35/65 | <0.1 | Not observed | 4.5 | 1.2 | 260 |
| II | 30/42 | <0.1 | Not observed | 4.6 | 1.1 | 262 |
| III | 40/55 | 0.1 | Not observed | 4.3 | 1.5 | 268 |
| IV | 43/57 | 0.12 | Not observed | 4.4 | 1.6 | 267 |
| V | 32/58 | <0.1 | Not observed | 4.5 | — | — |
| COMP I | 82/95 | 0.3 | 0.5–4 | 3.3 | 2.7 | 281 |
| COMP II | 86/95 | 0.4 | 0.5–3.8 | 3.2 | 2.8 | 286 |

EXAMPLE I

PREPARATION OF BIMODAL WAX. Polypropylene homopolymer 7957™ with a weight average molecular weight of about 280,000, obtained from Amoco Polymers, (4 lbs) was blended with VISCOL $_{660}$P™ polypropylene wax, with a weight average molecular weight of about 2,500, obtained from Sanyo Kaisei K.K. (26 lbs). The resulting blend was then fed into a Werner & Pfleiderer twin screw extruder at 6 pounds per hour using a loss-in-weight feeder. The mixing was accomplished in the extruder using the following process conditions: barrel temperature of 115° C., screw speed of 100 revolution per minute, and average residence time of about 3 minutes. The extrudate melt, upon exiting from the strand die, was cooled in a water bath and pelletized. The molecular weight of the extruded polypropylene blend was analyzed using high temperature gel permeation chromatography. The results showed a bimodal polypropylene blend consisting of two distinct molecular weight peaks: at about 2,300 and at about 250,000. The relative intensity of the two peaks was approximately proportional to the mixing ratio of the high molecular weight component to the low molecular weight wax of about 1.0:6.5.

PREPARATION OF TONER CONTAINING BIMODAL WAX. A crosslinked unsaturated polyester resin, as disclosed in U.S. Pat. No. 5,376,494, the disclosure of which is incorporated by reference herein in its entirety, was prepared by the reactive extrusion process by melt mixing 99.3 parts of a linear bisphenol A fumarate polyester base resin with an $M_n$ of about 4,000, an $M_w$ of about 10,300, an $M_w/M_n$ Of about 2.58 as measured by GPC, onset $T_g$ of about 55° C. as measured by DSC, and melt viscosity of about 29,000 poise at 100° C. and about 750 poise at 130° C. as measured at 10 radians per second, and 0.7 parts benzoyl peroxide initiator as outlined in the following procedure.

The unsaturated polyester resin and benzoyl peroxide initiator were blended in a rotary tumble blender for 30 minutes. The resulting dry mixture was then fed into a Werner & Pfleiderer ZSK-30 twin screw extruder with a screw diameter of 30.7 millimeters and a length-to-diameter (L/D) ratio of 37.2, at 10 pounds per hour using a loss-in-weight feeder. The crosslinking was accomplished in the extruder using the following process conditions: barrel temperature profile of 70/140/140/140/140/140/140° C., die head temperature of 140° C., screw speed of 100 revolutions per minute, and average residence time of about 3 minutes. The extrudate melt, upon exiting from the strand die, was cooled in a water bath and pelletized. The product, a crosslinked polyester, had an onset $T_g$ of about 54° C. as measured by DSC, melt viscosity of about 40,000 poise at 100° C. and about 150 poise at 160° C. as measured at 10 radians per second, a gel content of about 27 weight percent and a mean microgel particle size of about 0.1 micron as determined by transmission electron microscopy.

Thereafter, there was prepared in an extrusion device, available as ZSK28 from Werner & Pfleiderer, a toner composition by adding thereto 90 percent by weight of the above-mentioned crosslinked polyester resin containing from about 33 to about 40 weight percent gel content; 5 weight percent of the above prepared polypropylene bimodal blend pellet; and 5 weight percent of Regal 330® carbon black. The toner product was extruded at a rate of about 10 pounds per hour at about 150° C. The strands of melt mixed product exiting from the extruder were cooled by passing them through a water bath maintained at about 25° C. After air drying, the resulting toner was subjected to grinding in a Model 200AFG Alpine Fluid Bed Grinder to afford particles with a volume median diameter of from about 8 to about 12 microns as measured by a Coulter Counter. The 200AFG grinder was operated with a 3–4 mm nozzle at 100 psig pressure. The grinder wheel speed was set to obtain desired particle size. Thereafter, the toner particles were classified in a Donaldson Model B classifier for the purpose of removing fine particles, that is those with a volume median diameter of less than about 4 microns. This toner (3 lb. load) was then blended with small-sized external additives such as 0.6 weight percent TS-530 a hydrophobic treated fumed silica from Cabot Corporation at 2,740 rpm for about 2 minutes with an 80° F. jacket on a Henschel 10 L FM-10 blender.

The cohesion or toner powder flow of the resulting toner was about 35 using a Hosokawa Powder tester. The weight percent of the free wax particles in the toners of the present invention was determined to be less than the detection limit of about 0.1 weight percent, using a centrifugal density separation technique. The micronized toner particles were also examined by polarized optical microscopy and no free wax particles were observed. The percent of total wax in the toner composition as determined by differential scanning calorimetry was found to be about 4.5 percent by weight. Wax domain size was estimated from TEM photo analysis and found to be on average about 1.2 microns in diameter with a standard deviation of about 0.4 microns.

DEVELOPER The above formulated toner, 4 parts by weight, was then mixed with about 96 parts by weight of the carrier composition comprised of 99 percent by weight of an irregularly shaped steel core coated with 1 percent by weight of a Conductex SC Ultra conductive carbon black/poly (methylmethacrylate) composite, and wherein mixing was accomplished in a paint shaker for up to 60 minutes. There resulted on the toner composition, as determined in the known Faraday Cage apparatus, a negative triboelectric charge of 25 microcoulombs per gram after 60-minute paint shaking. The 60 minute paint-shaken toner showed only a small increase in percent cohesion from about 35 to about 45. A cohesion value of less than about 65 is desired for satisfactory development in a xerographic application.

The fusing properties of the above prepared classified toner were measured using a Xerox 5028™ fuser. Fusing conditions for the printing apparatus were varied to determine the minimum fix temperature behavior from developed images. Fusing evaluation by a standard image crease test was performed, and the minimum fix temperature of the toner was about 260° F. Generally a lower minimum fix temperature provides superior fusing results.

EXAMPLE II

BIMODAL WAX Polypropylene homopolymer, 7957™ obtained from Amoco Polymers, (8 lbs) was blended with VISCOL $_{660}$P™ polypropylene wax obtained from Sanyo Kaisei K. K. (22 lbs). The resulting blend was fed into a Werner & Pfleiderer twin screw extruder in the as in Example I. Molecular weight analysis of the extruded polypropylene showed two molecular weight peaks: at about 3,000 and at about 250,000.

TONER Thereafter, there was prepared in an extrusion device, available as ZSK28 from Werner & Pfleiderer, a toner composition by adding thereto 90 weight percent of crosslinked polyester resin (containing about 33–40 weight percent gel content); 5 weight percent of the above prepared polypropylene blend pellet; and 5 weight percent Regal 330® carbon black. The toner powder was prepared as in Example I. This toner (3 lbs load) was subsequently blended with small-sized external additives, 0.6 weight percent TS-530, a hydrophobic treated fumed silica obtained from Cabot Corporation.

The cohesion of the blended toner was about 30 using a Hosokawa Powder tester. The weight percent of the free wax particles was less than the detection limit of 0.1 weight percent for the prepared toners, using a centrifugal density separation technique. The micronized toner particles were also examined by polarized optical microscopy and no free wax particles were observed. The percent of total wax in the micronized toner composition as determined by differential scanning calorimetry was found to be about 4.6 percent by weight. Wax domain size was estimated from TEM photo analysis to be on average about 1.1 microns in diameter with a standard deviation of 0.5 microns. The fusing properties of the classified toner was measured using a Xerox 5028™ fuser. The minimum fix temperature of the toner was 262° F.

DEVELOPER The above formulated toner, 4 parts by weight, was mixed with 96 parts by weight of the carrier composition as in Example I, and mixing was accomplished in a paint shaker for up to about 60 minutes. There resulted on the toner composition, as determined in the known Faraday Cage apparatus, a negative triboelectric charge of 23 microcoulombs per gram after 60 minute paint shaking. This toner showed only a small increase in percent cohesion, from about 30 to about 42.

EXAMPLE III

BIMODAL WAX Polyethylene homopolymer (2 lbs, Mw 125,000 ) available from Aldrich Chemicals catalogue number 18190-0, was blended as in Example I with Polywax 2000™ polyethylene wax (8 lbs, $M_w$ 2,000 ) available from Petrolite Polymers. The resulting blend was fed into a Werner & Pfleiderer twin screw extruder as in Example I. Molecular weight analysis of the extruded polyethylene mixture by GPC showed two molecular weight peaks: at about 2,000 and at about 125,000.

TONER Thereafter, there was prepared in an extrusion device a toner and toner powder as in Example I. This toner (3 lbs load) was subsequently blended with small-sized external additives 0.6% TS-530, a hydrophobic treated fumed silica from Cabot Corporation. The cohesion of the blended toner was measured at about 40 using a Hosokawa Powder tester. The weight percent of the free wax particles was about 0.1 using a centrifugal density separation technique. The percent of total wax in the micronized toner composition as determined by differential scanning calorimetry was found to be about 4.3 percent by weight. Wax domain size was estimated by TEM photo analysis to be on average about 1.5 microns in diameter.

DEVELOPER The toner, 4 parts by weight, was mixed with 96 parts by weight of the carrier composition as in Example I, and mixing was accomplished in a paint shaker for about 60 minutes. There resulted on the toner composition, as determined in the known Faraday Cage apparatus, a negative triboelectric charge of 20 microcoulombs per gram after 60-minute paint shaking. This toner showed only a small increase in percent cohesion, from about 40 to about 55 percent. The fusing properties of the classified toner were measured using a Xerox $_{5028}$TM fuser. The minimum fix temperature of the toner was about 268° F.

EXAMPLE IV

SOLUTION BLENDING OF BIMODAL WAX Polyethylene homopolymer, catalogue number 18190-0 obtained from Aldrich Chemicals, (50 grams) was blended with Polywax 2000™ polyethylene wax from Petrolite Polymers (200 grams). The resulting blend was then dissolved in octanes at 60° C. After all polyethylene wax was dissolved, the solution was allowed to evaporate in a ventilated hood for 3 days at about 25° C. and then dried in a vacuum oven for 3 days at 100° C. The molecular weight properties of the dried polyethylene blend was analyzed using high temperature gel permeation chromatography and showed two molecular weight peaks: at about 2,000 and at about 125, 000.

TONER Thereafter, there was prepared in an extrusion device a toner powder as in Example I. This toner (3 lbs load) was subsequently blended with small-sized external additives, 0.6% TS-530, a hydrophobic treated fumed silica from Cabot Corporation. The cohesion of the blended toner was about 43 percent using a Hosokawa Powder tester. The weight percent of the free wax particles was about 0.12 a centrifugal density separation technique. The percent of total wax in the micronized toner composition as determined by differential scanning calorimetry was found to be about 4.4 percent by weight. Wax domain size estimated by TEM photo analysis was on average about 1.6 microns in diameter.

DEVELOPER The toner, 4 parts by weight, was mixed with 96 parts by weight of the carrier composition as in Example I, and mixing was accomplished in a paint shaker for 60 minutes. There resulted on the toner composition, as determined in the known Faraday Cage apparatus, a negative triboelectric charge of 19 microcoulombs per gram. The 60 minute paint-shaken toner showed only a small increase in percent cohesion of from about 43 to about 57. The fusing properties of the above prepared classified toner was measured using a Xerox $5_02_8$TM fuser. The minimum fix temperature of the toner was 267° F.

EXAMPLE V

TRIMODAL WAX PREPARATION Example II was repeated with the exception that a third wax component of intermediate molecular weight was added to the mixture to form a trimodal wax blend. The trimodal blend included polypropylene homopolymer 7957™ from Amoco Polymers (8 lbs), VISCOL 660P™ polypropylene wax from Sanyo Kaisei K.K. (11 lbs), and VISCOL 550P™ polypropylene wax from Sanyo Kaisei K.K. (11 lbs). The resulting blend was fed into a Werner & Pfleiderer twin screw extruder as in Example I. Molecular weight analysis of the extruded polypropylene blend showed three main molecular weight peaks: at about 3,000, about 8000, and about 250,000.

TONER WITH TRIMODAL WAX Thereafter, there was prepared in an extrusion device, available as ZSK28 from Werner & Pfleiderer, a toner composition by adding thereto 90 weight percent of crosslinked polyester resin (containing about 33–40 weight percent gel content) of Example I; 5 weight percent of the above prepared trimodal polypropylene blend pellet; and 5 weight percent Regal 330® carbon black. The toner powder was prepared and processed as in Example I. This toner (3 lbs. load) was subsequently blended with small-sized external additives, 0.6 weight percent TS-530, a hydrophobic treated fumed silica obtained from Cabot Corporation. The cohesion of the blended toner was about 32 using a Hosokawa Powder tester. The weight percent of the free wax particles was less than the detection limit of 0.1 weight percent for the prepared toners, using a centrifugal density separation technique. The micronized toner particles were also examined by polarized optical microscopy and no free wax particles were observed. The percent of total wax in the micronized toner composition as determined by differential scanning calorimetry was about 4.5 percent by weight.

DEVELOPER The above formulated toner, 4 parts by weight, was mixed with 96 parts by weight of the carrier composition as in Example I, and mixing was accomplished in a paint shaker for up to about 60 minutes. There resulted on the toner composition, as determined in the known Faraday Cage apparatus, a negative triboelectric charge of 23 microcoulombs per gram after 60 minute paint shaking. This toner showed only a small increase in percent cohesion, from about 32 to about 58.

COMPARATIVE EXAMPLE I

TONER WITH MONOMODAL WAX There was prepared in an extrusion device, available as ZSK-40 from Werner Pfleiderer, a toner composition by adding to the extrusion device 90 percent by weight of a crosslinked polyester resin consisting of a bisphenol-A propylene oxide fumarate terpolymer, with about 33 to 40 percent gel content, 5 percent by weight of REGAL 330® carbon black pigment, 5 percent by weight of 660P Sanyo polypropylene wax, a monomodal wax with a weight average molecular weight of about 3,000. The product was then extruded at a rate of 20 pounds per hour at about 150° C. The melt product exiting from the extruder was cooled to about 25° C. on a belt and then crushed into small particles. The resulting toner was subjected to grinding on an AFG micronizer, model 200AFG, to provide toner particles with a volume median diameter of 8 to 12 microns as measured by a Coulter Counter. Thereafter, the aforementioned toner particles were classified in a Donaldson Model B classifier for the purpose of removing fines particles, that is, those with a volume median diameter of less than about, or equal to about four microns. The final volume median diameter of the toner after classification was 9.48 microns. This toner (3 lbs load) was subsequently blended with small-sized external additives 0.6% TS-530, a hydrophobic treated fumed silica from Cabot Corporation at 2,740 RPM for 2 minutes with 80° F. jacket on Henschel 10 L FM-10 blender. Cohesion of the above classified toner was 82.0 using a Hosokawa Powder Tester instrument. The free wax particles were about 0.3 weight percent using a centrifugal density separation technique. The micronized toner particles were also examined by polarized optical microscopy and free wax particles ranging from about 0.5 microns to about 4 microns were observed. The percent of total wax in the micronized toner composition as determined by differential scanning calorimetry was found to be about 3.3 percent by weight. Wax domain size was estimated by TEM photo analysis to be on average about 2.7 microns in diameter with a standard deviation of 1.0 micron.

DEVELOPER The formulated toner, 4 parts by weight, was mixed with 96 parts by weight of the carrier composition comprised of 99 percent by weight of an irregularly shaped steel core coated with 1 percent by weight of a Conductex SC Ultra conductive carbon black/poly (methylmethacrylate) composite), and wherein mixing was accomplished in a paint shaker for up to 60 minutes. There resulted on the toner composition, as determined in the known Faraday Cage apparatus, a negative triboelectric charge of 11 microcoulombs per gram. This toner showed an increase in percent cohesion from about 82 to about 95. Recall that a cohesion value of less than about 65 is desired for satisfactory development in a xerographic apparatus. The fusing properties of the classified toner was measured using a Xerox $_{5028}$™ fuser. Fusing conditions for the printing apparatus were varied to determine the minimum fix temperature behavior from the developed image. Fusing evaluation by a standard image crease test was performed and the minimum fix temperature of the toner was found to 281° F.

COMPARATIVE EXAMPLE II

COMPARATIVE EXAMPLE I was repeated with the exception that 5 weight percent Polywax 2000™ polypropylene wax was used as the monomodal wax. A cohesion value of the classified toner was about 86. The weight percent of the free wax particles in the toner was about 0.4 as determined using a centrifugal density separation technique. The micronized toner particles were also examined by polarized optical microscopy and free wax particles ranging from about 0.5 microns to about 3.8 microns were observed. The percent of total wax in the micronized toner composition as determined by differential scanning calorimetry was found to be about 3.2 percent by weight. Wax domain size was estimated by TEM photo analysis to be on average about 2.8 microns in diameter with a standard deviation of 1.2 microns.

DEVELOPER The formulated toner, 4 parts by weight, was mixed with 96 parts by weight of the carrier composition (carrier is comprised of 99 percent by weight of an irregularly shaped steel core coated with 1 weight percent of a Conductex SC Ultra conductive carbon black/poly (methylmethacrylate) composite, and wherein mixing was accomplished in a paint shaker for about 60 minutes. There resulted on the toner composition, as determined in the known Faraday Cage apparatus, a negative triboelectric charge of 11 microcoulombs per gram. The resulting toner showed an increase in percent cohesion, from about 86 to about 95.

The fusing properties of the above prepared classified toner was measured using a Xerox 5028™ fuser. Fusing conditions for the imaging device were varied so as to determine the minimum fix temperature behavior from the developed image. Fusing evaluation by a standard image crease test was performed and the minimum fix temperature of the toner was found to about 286° F.

Other modifications of the present invention may occur to one of ordinary skill in the art based upon a review of the present application and these modifications, including equivalents thereof, are intended to be included within the scope of the present invention.

What is claimed is:

1. A toner comprising a resin, a colorant, and a homogenous bimodal wax, wherein the homogenous bimodal wax comprises a first low molecular weight component with a weight average molecular weight of about 1,000 to about 4,000, and a second high molecular weight component with a weight average molecular weight of about 10,000 to about 1,000,000.

2. A toner in accordance with claim 1, wherein the resin is selected in an amount of from about 10 to about 99 weight percent, the colorant is selected in an amount of from about 1 to about 60 weight percent, and wherein the homogenous bimodal wax is present in distinct domains and in amounts of from about 0.01 to about 20 weight percent of the total weight of the toner.

3. A toner in accordance with claim 1, wherein the homogenous bimodal wax is present in an amount of from about 0.5 to about 5 weight percent of the total weight of the toner.

4. A toner in accordance with claim 1, further comprising a third wax component of intermediate molecular weight with a weight average molecular weight of about 6,000 to about 9,000, and wherein the resulting homogenous trimodal wax mixture provides a toner with about 30 weight percent less surface wax compared to a comparable toner containing only a monomodal wax component.

5. A toner in accordance with claim 1, wherein the weight average molecular weight difference between the high molecular weight component and the low molecular weight component is from about 10,000 to about 500,000.

6. A toner in accordance with claim 1, wherein the cohesion flow value of the toner composition is from about 30 to about 65 percent.

7. A toner in accordance with claim 4, further comprising combining from 1 to about 10 additional wax components to provide a toner containing an homogenous oligomodal wax.

8. A toner in accordance with claim 7, wherein the number of the molecular weight distribution peaks of the homogenous oligomodal wax is from about 4 to about 10.

9. A toner in accordance with claim 1, further comprising a charge additive present in an amount of from about 0.05 to about 5 weight percent.

10. A toner in accordance with claim 1 wherein the resin is a styrene-butadiene, a styrene acrylate, a styrene alkylacrylate, a polyester, and mixtures thereof.

11. A toner composition in accordance with claim 1, wherein the resin is a polyester, a copolyester, a cross-linked polyester, a cross-linked copolyester, and mixtures thereof.

12. A toner in accordance with claim 1, wherein the colorant is a pigment, a dye and mixtures thereof, and is present in amounts of from about 1 to about 20 weight percent based on the total weight of the toner.

13. A toner in accordance with claim 1, wherein the toner is substantially without free wax.

14. A toner in accordance with claim 1, wherein the toner has an admix time of from less than about 1 to about 15 seconds, and with a triboelectric charge of from about 10 to about 40 microcoulombs per gram.

15. A toner composition in accordance with claim 1, wherein the homogenous bimodal wax is selected from the group consisting of polyalkylene waxes prepared from unsaturated monomers having from 2 to about 12 carbon atoms, paraffin waxes, carnuba waxes, oxidized polyolefins, polyolefins with acid groups, polyolefins with hydroxyl groups, and mixtures thereof.

16. A process comprising:

admixing a first high molecular weight monomodal wax component with a second low molecular weight monomodal wax component to form a homogenous bimodal wax mixture; and admixing the homogenous bimodal wax mixture with a resin and a colorant to form a toner, wherein the bimodal wax comprises a first low molecular weight component with a weight average molecular weight of about 1,000 to about 4,000, and a second high molecular weight component with a weight average molecular weight of about 10,000 to about 1,000,000.

17. A process in accordance with claim 16, wherein said first and second monomodal wax components are comprised of compounds of the same monomeric species and differ only in molecular weight distributions, wherein the weight ratio of the first low molecular weight wax component to the second high molecular weight wax component is about 0.05 to about 0.60, and the molecular weight ratio of the high molecular weight component to the low molecular weight wax component is from about 10 to about 1,000.

18. A process in accordance with claim 16, wherein the homogenous bimodal wax mixture has a polydispersity of about 10 to about 100, and wherein both monomodal wax components are selected from the group consisting of polyalkylene waxes prepared from unsaturated monomers having from 2 to about 12 carbon atoms, paraffin waxes, carnuba waxes, oxidized polyolefins, polyolefins with acid groups, polyolefins with hydroxyl groups, and mixtures thereof.

19. An imaging process comprising:

contacting a toner comprising a resin, a colorant, and a homogenous bimodal wax, with a charged image receiving member, wherein a printed image results with high image quality and fidelity, and wherein the bimodal wax comprises a first low molecular weight component with a weight average molecular weight of about 1,000 to about 4,000, and a second high molecular weight component with a weight average molecular weight of about 10,000 to about 1,000,000.

* * * * *